United States Patent [19]

Kryanin et al.

[11] 4,240,494

[45] Dec. 23, 1980

[54] METHOD FOR CENTRIFUGAL CASTING OF TUBULAR METAL BLANKS

[76] Inventors: Ivan R. Kryanin, Sharikopodshipnikovskaya ulitsa, 2, kv. 68; Genrikh S. Mirzoian, Flotskaya ulitsa, 7, korpus 5, kv. 338; Nikolai N. Alexandrov, Sharikopodshipnikovskaya ulitsa, 2, kv. 126; David S. Shoshiashvili, Sumskoi proezd, 2, korpus 1, kv. 335; Viktor M. Krapukhin, Suvorovsky bulvar, 15, kv. 13, all of Moscow; Gleb S. Akubov, ulitsa Kommunarov, 212, kv. 54, Izhevsk; Evgeny V. Gerlivanov, ulitsa M. Gorkogo, 136, kv. 9, Izhevsk; Vladimir M. Lvov, ulitsa Udmurtskaya, 247, kv. 89, Izhevsk; Mark M. Komarov, ulitsa 10 let Oktyabrya, 20, kv. 89, Izhevsk, all of U.S.S.R.

[21] Appl. No.: 922,582

[22] Filed: Jul. 6, 1978

[51] Int. Cl.[3] ..... B22D 13/02

[52] U.S. Cl. ..... 164/66; 164/114

[58] Field of Search ..... 164/114, 298, 66, 259

[56] References Cited

U.S. PATENT DOCUMENTS

| | | | |
|---|---|---|---|
| 1,987,752 | 1/1935 | Salzman | 164/259 |
| 2,087,347 | 7/1937 | Larsen | 164/66 |
| 3,263,285 | 8/1966 | Rojecki | 164/114 |

FOREIGN PATENT DOCUMENTS

| | | | |
|---|---|---|---|
| 431064 | 7/1926 | Fed. Rep. of Germany | 164/298 |
| 535563 | 10/1931 | Fed. Rep. of Germany . | |
| 587601 | 11/1933 | Fed. Rep. of Germany | 164/259 |
| 1287754 | 1/1969 | Fed. Rep. of Germany . | |
| 1304956 | 8/1962 | France . | |
| 38-20805 | 10/1963 | Japan | 164/66 |
| 43-24402 | 10/1968 | Japan | 164/114 |
| 222732 | 9/1968 | Sweden . | |

*Primary Examiner*—Robert D. Baldwin

*Attorney, Agent, or Firm*—Haseltine, Lake & Waters

[57] ABSTRACT

The present invention is intended for the production of long, large diameter tubular blanks (over 5 m in length and over 800 mm in diameter). According to the method, positive pressure of an inert gas is created inside a spinning mold and maintained there in the process of pouring molten metal thereinto. That provides for the equal speeds of the mold rotation and the metal movement within the mold, and thereby promotes the production of tubular blanks with a uniform structure.

5 Claims, 1 Drawing Figure

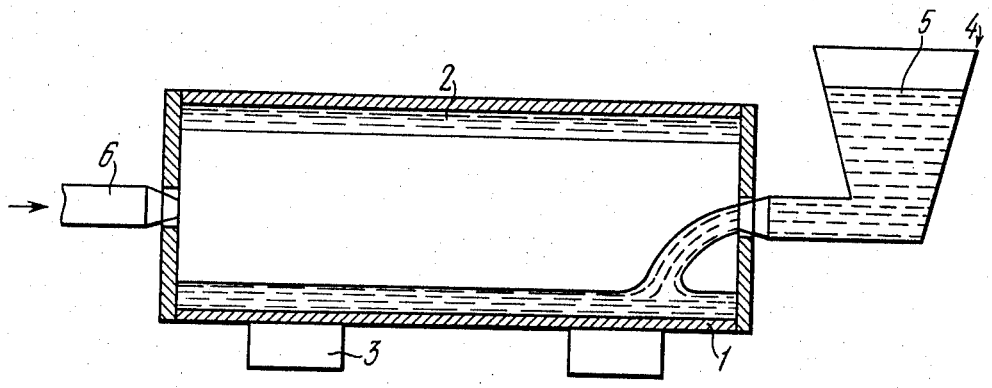
5
4
2
6
3
1

METHOD FOR CENTRIFUGAL CASTING OF TUBULAR METAL BLANKS

The present invention relates to metal casting, and more particularly to a method of centrifugal casting of tubular metal blanks. The invention can most effectively be used for casting long, large-diameter tubes of various alloys (over 5 m in length and 600 to 2,000 mm in diameter).

The present invention can be used in many industrial applications (e.g. power engineering, papermaking, oil-and-gas engineering, chemical engineering, etc.), wherein liquid, gas, and various agressive media are conveyed along pipelines at high temperatures and pressures.

Modern steam and nuclear power-plant equipment and paper mills tend to grow in size and output, and that entails the use of long, large-diameter pipelines therefor. Thus, for instance, big steam power plants feature pipelines made up of tubes no less than 6 m in length and 800 to 1,200 mm in diameter.

Such large-size seamless tubes are cumbersome and costly to produce by rolling. This particular problem, however, can be economically solved using advanced casting processes, e.g. centrifugal casting.

Here, molten metal inside a spinning metal mold is centrifugally forced to the mold walls and then solidifies, thus forming a casting. Such a method is widely used for obtaining tubular castings, e.g., cast-iron and steel pipes, rings, sleeves, and shells. The molds therefor are installed in centrifugal casting machines. The castings obtained thereby feature an increased density of the external layer.

Yet the casting of large-size objects, unlike that of small and medium size castings about 200 to 500 mm in diameter, presents a number of difficulties.

One of the main problems in centrifugal casting of large-size tubular blanks is to obtain a casting with a uniform structure throughout its cross-section for high physical and mechanical properties thereof.

The most common defect of a large-size casting is its banded structure, an attribute which is used to define the physico-chemical and structural non-uniformity of the casting metal.

The banded structure of castings substantially downgrades physical and mechanical properties of the metal and results in its stratification. It is therefore obvious that bonded-structure castings cannot be used for critical engineering components.

Another problem in centrifugal casting of large-size tubular blanks is to obtain an adequate surface finish of the external surface thereof.

Surface defects arise as the metal moves along the internal surface of the spinning mold over a fairly long distance (in excess of 5 m), which causes substantial heat losses at the end portion of the mold. That results in the scaling of metal from the external surface of the blank.

Such blanks are also rejected, because these surface defects form the pockets of stress concentration and may cause cracks in the blank.

The surface defects may be removed by subsequent machining, but that takes drastically increased (four to six times) machining allowances for the casting external surface.

The banded structure of centrifugally cast blanks is caused by the relative displacements of the metal layers in the course of pouring and solidification of the metal.

These displacements are brought about by a difference between the speed of the metal being poured in and that of the mold rotation, with a commonly used gravitational factor being $$K = m\Omega^2 R/mg \approx 60$$

where $m\Omega^2 R$ = centrifugal force;

$mg$ = gravitational force;

$\Omega = \pi N/30$ = mold angular speed (n = r.p.m.)

$R$ = blank external surface radius;

$g$ = gravity acceleration;

$m$ = mold mass.

Therefore, measures should be taken to prevent the relative displacement of the metal layers.

There has been known a method for preventing the banded structure through a dynamic action upon the metal during its rotation by periodically retarding the spinning mold (cf. "Tsentrobezhnoe lit'e" S. B. Yudin et all, Mashinostroenie, 1962).

The underlying idea here is that the metal in the mold receives vibration, which makes it possible to avoid relative displacements of the metal layers.

This method, however, fails to produce the desired effect, because moderate actions upon the molten metal do not prevent the relative displacements of the metal layers, whereas actions of greater intensity may even promote these relative displacements.

There has also been known a method for creating positive pressure of an inert gas to act upon the solidifying metal poured into the mold in order to obtain a fine-grain structure of the casting (cf. Jap. Pat. No. 20609).

Yet this method also cannot produce an adequate effect, because the gas pressure created within the mold after the molten metal has been poured in does not prevent the relative displacements of the metal layers taking place in the course of pouring. For this reason, the banded structure of the tubular blank hereby obtained is not eliminated.

Specific measures are also required to obtain high-quality large-size tubular castings which are free of surface defects due to the scaling of metal on the casting external surface.

There has been known a method for preventing metal scaling in casting tubular blanks, whereby the pouring temperature of the metal is increased by 70° to 100° C. over its solidification temperature.

This increase in the pouring temperature fails to produce an effect with tubular blanks over 5 m long, while affecting the quality of the metal through its increased gas saturation.

In addition, there is known a method for centrifugal casting of tubular blanks whereby molten metal is poured into a spinning mold through a long (over 5 m) movable pipe, which is disposed along the mold axis of rotation and forms a runner.

The drawback of this method is that the runner, which sags and becomes otherwise deformed inside the mold, is impossible to remove therefrom. This may cause a breakdown to an installation that utilizes the method.

For the reasons set forth in the foregoing, all these methods of centrifugal casting make it impossible to obtain high-quality large-diameter tubular blanks over 5 m long.

It is an object of the present invention to improve the quality of long, large diameter tubular metal blanks over 5 m in length and over 800 mm in diameter obtained by centrifugal casting.

Another object of the invention is to provide for higher productive output in the centrifugal casting of long tubular blanks.

Still another object of the invention is to provide for reduced cost of long tubular blanks obtained by centrifugal casting.

These and other objects of the invention are accomplished by a method for centrifugal casting of tubular metal blanks, comprising the pouring of molten metal into a spinning mold and the action of positive pressure of an inert gas upon the metal in the mold, said mold having the gravitational factor (centrifugal force-to-gravitational force ratio) of a value at which the external surface of the blank is formed, wherein, according to the invention, said molten metal is poured into said mold at a positive pressure of an inert gas delivered thereto.

The method according to the invention makes it possible to improve the quality of tubular blanks thus obtained. Owing to the positive pressure of an inert gas that is delivered to the mold prior to pouring molten metal thereinto, said metal acquires a speed equal to that of the mold rotation through the increased forces of friction not only between the mold and the metal, but also inside the metal itself.

In this way, relative displacements of the metal layers are prevented, thereby excluding the formation of a banded structure in the blank, which assumes a uniform structure.

The present invention in one form provides for an increase in the mold gravitational factor by 300% over its value at which the blank external surface is formed, said increase being created for the period of pouring the metal into the mold.

The changed speed of the mold rotation to provide said increase as the metal is being poured into the mold, makes for faster movement of the metal toward the end portion of the mold. This creates a uniform temperature field along the blank, and so prevents the formation of metal scaling on the blank external surface.

Other objects and advantages of the invention will become apparent from the following detailed description of its embodiment made with reference to the accompanying drawings, wherein there is diagrammatically illustrated the principle of a device for carrying out the method according to the invention.

Referring to the drawing, a mold 1 wherein a tubular blank 2 is formed is placed on rollers 3 which receive rotation from a suitable drive (not shown). A gating system 4 for the delivery of molten metal 5 to the mold 1 is mounted at one end face of the latter. The other end face of the mold 1 carries an inlet pipe 6 for the delivery thereto of an inert gas under pressure.

The device operates as follows.

Prior to pouring the molten metal 5 through the gating system 4 into the spinning mold 1, the mold chamber is filled through the pipe 6 with an inert gas to create a positive pressure therein. Depending on the specified thickness of the wall of the tubular blank 2 to be obtained, the value of the gas pressure inside the mold 1 is 3, 4, and 5 atm for a blank wall thickness of 100, 200, and 300 mm, respectively.

Once the required pressure therein is set up, the spinning mold 1 is filled with the metal 5 from the gating system 4. Some quantity of metal powder (2 to 4% of the weight of the metal 5 within the mold 1) is also put thereinto in the course of pouring. That makes for increased density of the alloy and produces the effect of "solid-body rotation" of the metal 5 in the mold 1. The use of a gas pressure in combination with the pouring of molten metal containing metal powder proves to be more expedient as the blank wall thickness increases in excess of 100 mm.

During the process of pouring of the metal 5 into the mold 1, the gravitational factor of the latter $K=m\Omega^2R/mg$ (where $M\Omega^2R$=centrifugal force, and mg=gravitational force) is 300% over the value at which the external surface of the tubular blank 2 is formed.

With the pouring finished, the rotational speed of the mold 1 is reduced to obtain a gravitational factor value that is 200% over the value at which the formation of the external surface of the blank 2 takes place.

As compared with conventional methods of centrifugal casting, the method according to the present invention makes it possible to cut the production costs of tubular blanks by a factor of 4 to 5 and to increase the productive output 2 to 3 times.

What is claimed is:

1. A method for centrifugal casting of tubular metal blanks, comprising the pouring of molten metal into a spinning mold at a positive pressure of 3 to 5 atmospheres of an inert gas delivered countercurrently thereinto, said mold featuring a gravitational factor at which the external surface of the tubular blank is formed wherein for the period of the pouring of metal into said mold the speed of rotation of the mold is increased to provide a gravitational factor thereof whose value exceeds by 300% said value of the gravitational factor of said mold at which the external surface of said tubular blank is formed.

2. The method as claimed in claim 1 wherein the blanks are over 5 m in length and over 800 mm in diameter.

3. The method as claimed in claim 1 wherein the molten metal poured into the mold contains from 2 to 4% of metal powder.

4. The method as claimed in claim 1 wherein the gravitational factor is decreased, after pouring, to 200% greater than the gravitational factor of said mold at which the external surface of said tubular blank is formed.

5. The method as claimed in any one of claims 1 or 2–4 inclusive wherein said gas pressure is 3, 4 and 5 atm for a blank wall thickness of 100, 200 and 300 mm, respectively.

* * * * *